United States Patent [19]

Widart

[11] Patent Number: 4,802,273

[45] Date of Patent: Feb. 7, 1989

[54] HYDRAULIC EXPANSION TOOL FOR TUBULAR ELEMENT

[75] Inventor: Jean E. Widart, Saint Severin, Belgium

[73] Assignee: Cockerill Mechanical Industries, Belgium

[21] Appl. No.: 33,100

[22] PCT Filed: Apr. 17, 1986

[86] PCT No.: PCT/BE86/00024

§ 371 Date: Feb. 26, 1987

§ 102(e) Date: Feb. 26, 1987

[87] PCT Pub. No.: WO87/00457

PCT Pub. Date: Jan. 29, 1987

[30] Foreign Application Priority Data

Jul. 18, 1985 [BE] Belgium ..... 0/215371

[51] Int. Cl.[4] ..... B23P 11/00; B21D 26/02

[52] U.S. Cl. ..... 29/421.1; 29/727; 72/56

[58] Field of Search ..... 72/58, 56, 60–62, 72/393; 29/421 R, 523, 727; 166/207, 212

[56] References Cited

U.S. PATENT DOCUMENTS

| | | | |
|---|---|---|---|
| 2,691,418 | 10/1954 | Connolly | 166/212 |
| 2,799,348 | 7/1957 | Page | 166/212 |
| 3,220,235 | 11/1965 | Peccerill | 72/62 |
| 4,210,991 | 7/1980 | Cooper | 29/421 R |
| 4,467,630 | 8/1984 | Kelly | 72/62 |
| 4,608,738 | 9/1986 | Miller | 29/421 R |
| 4,616,392 | 10/1986 | Snyder | 29/727 |

FOREIGN PATENT DOCUMENTS

| | | | |
|---|---|---|---|
| 2754666 | 6/1979 | Fed. Rep. of Germany | 72/62 |
| 2820324 | 11/1979 | Fed. Rep. of Germany | 72/62 |
| 1330224 | 5/1963 | France . | |

*Primary Examiner*—Lowell A. Larson

*Attorney, Agent, or Firm*—Kramer, Brufsky & Cifelli

[57] ABSTRACT

To an elongate body (1) having preferably an adjustable length, seals (2, 3) are fixed. The seals comprise a skirt (22) forming a crown which surrounds a body portion at a small distance from the surface thereof, the skirt being made of a material having a flexibility sufficient to be slightly reduced in diameter when the tool is introduced into a tubular element to be expanded. The skirts of the two seals may be interconnected, thus outwardly delimiting an internal ring-shaped chamber (20) intended to receive an expansion fluid.

7 Claims, 6 Drawing Sheets

Figure 1:
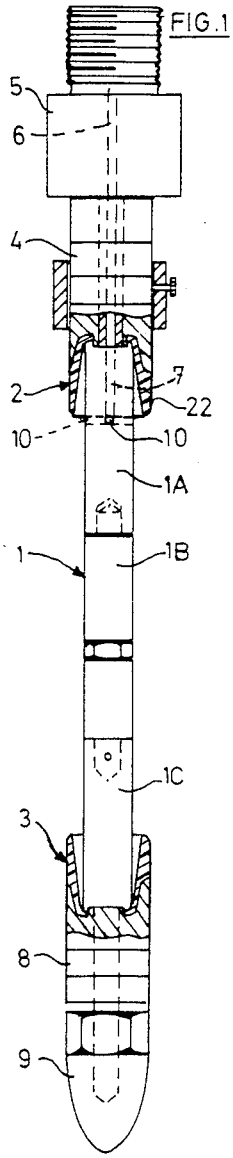

5
6
4
2
7
22
10
10
1A
1
1B
1C
3
8
9

21
2
24
22
1
23
25
T 2
21
1
T
22

26

22
2
7

26
22
26
2
7

HYDRAULIC EXPANSION TOOL FOR TUBULAR ELEMENT

In the manufacture of numerous industrial apparatus (heat exchangers, steam generators, self-bound tubes, for example), it is necessary to expand tubular elements in order to assemble and fix these tubular elements. The diameters and thicknesses of these tubular elements may vary considerably. As a guide, the tubes of steam generators for use in nuclear power stations have diameters of the order of 20 mm and a wall thickness of the order of 1 mm whereas certain self-bound tubes used in defence equipment have diameters of the order of 100 to 200 mm and a wall thickness of the order of 40 to 80 mm.

A method currently used to expand tubular elements is hydraulic expansion. Conventionally, hydraulic expansion is carried out using a mandrel or expander which is introduced into the tube which is to be expanded and supplied with pressurised fluid. The expander is provided with annular seals of very small cross-section which close off, in leaktight manner, the ends of the annular hydraulic expansion chamber formed between the internal surface of a tube which is to be expanded and the external surface of the expander when the latter is in position inside the tube. Seals of this kind having a constant diameter and cross section do not guarantee satisfactory contact with the inner surface of the tube if the diameter of the tube varies in accordance with normal manufacturing tolerances. Consequently, it is frequently necessary to use several expanders and seals of different diameters in order to follow the variations in the internal diameter of the tubes. Moreover, if the minimum diameter of a tube corresponds to the maximum diameter of the hole which is intended to receive the tube, there may also be leakage at the seal and, furthermore, the tube may not be adequately expanded against the wall of the hole.

Finally, in view of the small diameter of the seals (generally of the order of 1 to 2 mm), the deformation of the tube between the expanded part and the non-expanded part is considerable. This results in substantial stresses in this zone and, during the service life of the apparatus, cracking may develop which threatens the reliability of the equipment, requiring shutdown of the installations and sealing of the defective tubes.

The aim of this invention is to remedy the disadvantages of the prior art by means of an hydraulic tube expansion tool, comprising a body which carries at least one pair of seals, each seal comprising a head fixed on the surface of the elongate body and a skirt forming a crown which surrounds a portion of the elongate body at a small distance from the outer surface thereof, the skirt being made of a material having of sufficient flexibility to be slightly reduced in diameter when the tool is introduced into a tubular element.

In an embodiment by way of example, the skirts of the seals which constitute a pair are connected to each other in order to outwardly delimite an inner annular chamber intended to receive an expansion fluid. Rings are advantageously clamped against the heads of the seals and may, if necessary, envelop the flexible skirts partially or totally. These rings consist, for example, of a plurality of abutting sectors and a cylindrical cover may be slid around these rings in order to act as a stress distributor between the sectors and the tubular element which is to be expanded.

In order to carry out expansion over considerable lengths, the seal according to the invention may be mounted on an elongate body comprising an internal expansion chamber which extends between two pressure compartments, the first pressure compartment communicating solely with the internal expansion chamber, whilst the second pressure compartment communicates with the internal expansion chamber and with an intake channel for a pressurised fluid intended to create pressure in the pressure compartments in order to maintain constant elongation of the body of the tool all the time that there is pressure in the annular expansion chamber.

The invention also relates to a process for hydraulically expanding a long tube which ensures that the seals of the hydraulic expansion chamber are only displaced when the pressure is zero in the expansion chamber, thus ensuring a perfect seal during the increase in pressure and thereby extending the service life of the seals.

Figure 2:
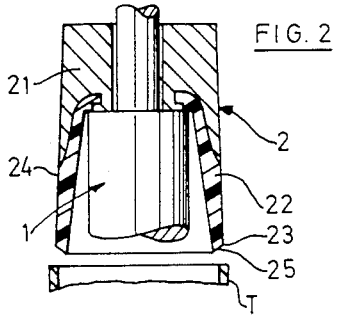
Figure 3:
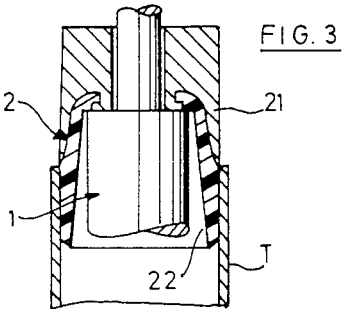
Figure 4:
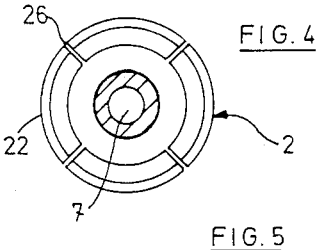
Figure 5:
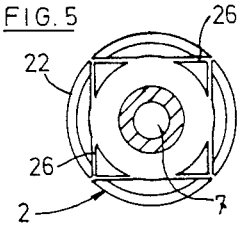
Figure 6:
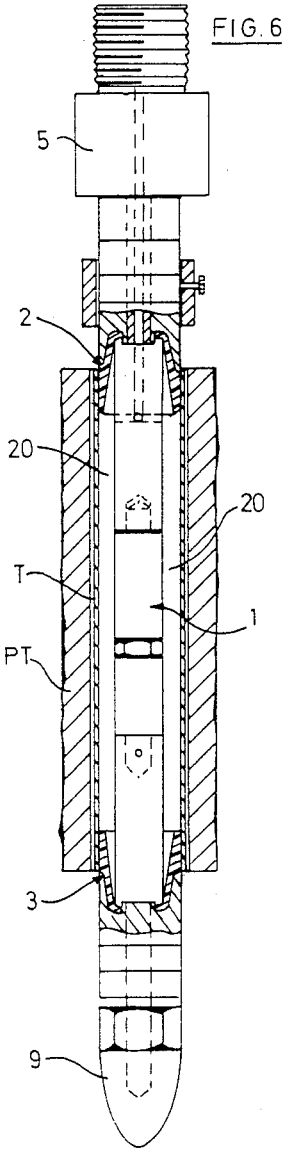
Figure 7:
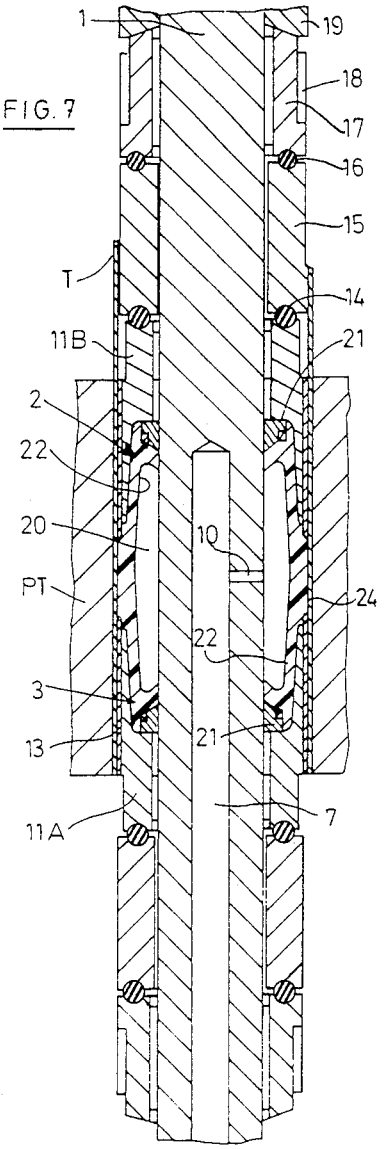
Figure 8:
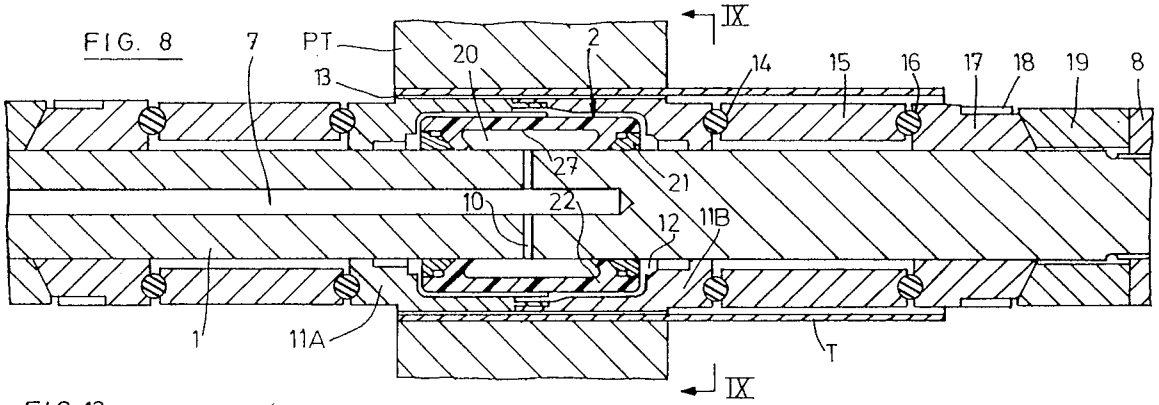
Figure 14:
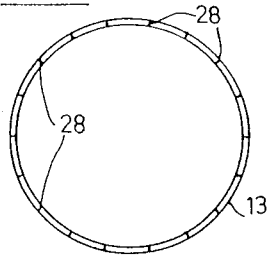
Figure 13:
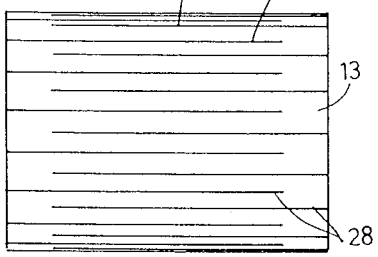
Figure 15:
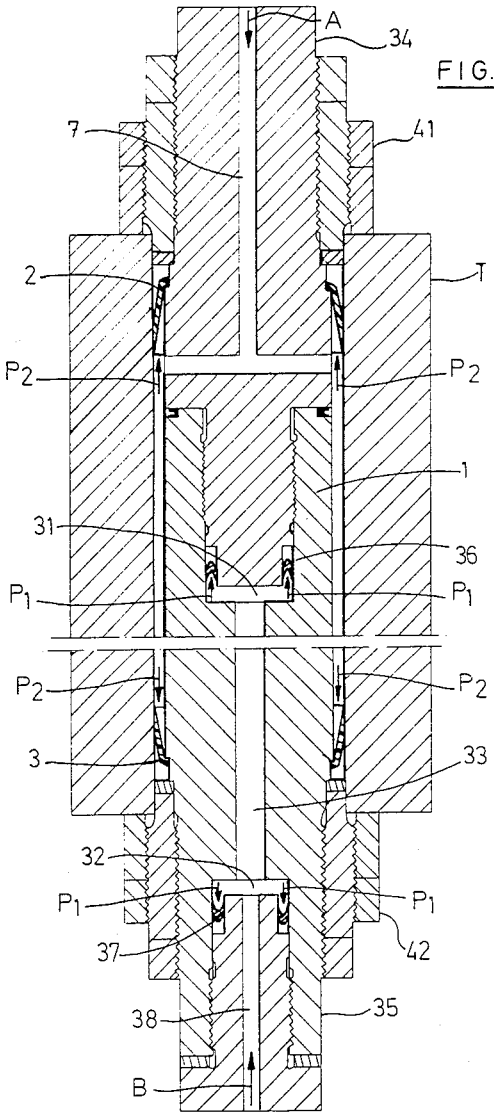

The invention is hereinafter explained with reference to the accompanying drawings, wherein:

FIG. 1 is a view of a first embodiment by way of example of the tool according to the invention, FIG. 2 is a section through an embodiment of the seal according to the invention used in the tool shown in FIG. 1, FIG. 3 shows the seal of FIG. 2 introduced into a tube which is to be expanded, FIGS. 4 and 5 illustrate two embodiments of the skirt of a seal according to the invention, FIG. 6 shows the tool according to FIG. 1 in position inside a tube which is to be expanded in a tube plate, FIGS. 7 to 12 show various alternative embodiments of the seal according to the invention, FIGS. 13 and 14 show a longitudinal elevation and side elevation, respectively, of an embodiment of a casing used with the seal shown in FIGS. 7 and 8, FIG. 15 is a section through a second embodiment of the tool according to the invention.

In the embodiment by way of example shown in FIG. 1, the hydraulic expansion tool comprises an elongate body or spindle 1 having at its ends two seals 2 and 3 according to the invention. The body 1 is made up, for example, of three parts 1A, 1B and 1C screwed into one another. The length of the body 1 and hence the distance between the seals 2 and 3 is adjustable by suitably screwing the parts 1A and 1C into the centre part 1B with the interposition of washers, if necessary. The seal 2 is tightened against one end of the body 1 by a compression member 4 internally fastened in the body. Above the compression member 4 is mounted a connecting member 5 for connecting the tool to a hydraulic unit intended to supply the tool with pressurised fluid. The connecting member 5 and the compression member 4 are axially traversed by a fluid intake conduit 6 which communicates with an expansion fluid conduit 7 formed in the body 1 and opening out onto the external side surface of the body through orifices 10. The seal 3 is tightened against the other end of the body 1 by a compression member 8 internally fastened in the body 1 and in front of the compression member 8 is fixed the insertion head 9. The seals comprise a cylindrical or truncated cone-shaped head 21 fixed to the body 1 and a skirt 22 which forms a crown surrounding a portion of the body 1 at a small distance from the outer surface thereof. In the embodiment shown in FIG. 2, the thickness of the skirt decreases towards its outer edge 23 and the skirt also has a marginal zone 24 the external diameter of which is slightly greater than the internal diameter of the tube T which is to be expanded. At its outer edge 23, the skirt 22 of the joint preferably has a bevel 25 enabling it to be introduced more easily into a tube. The skirt 22 is advantageously made of a flexible or relatively flexible material so that it reduces slightly in diameter when inserted into a tube to be expanded (FIG. 3).

The geometric shape and the composition of the material of the skirt may be adapted to each specific application. It might be possible to have a skirt made of extremely flexible material for considerable expansion under low pressure or a skirt made of relatively flexible material for moderate expansion under very high pressure. It is also possible to envisage a skirt consisting of a number of materials for other uses. Similarly, the geometric shape of the skirt may be specific to the deformation which the operator wishes to achieve on the tubular element after hydraulic expansion.

In order to improve the flexibility, if necessary, the skirt 22 of the joints may be divided into sections by grooves of small width. FIGS. 4 and 5 show two embodiments by way of example. In the example shown in FIG. 4, the grooves 26 in the skirt 22 are radial and in the example shown in FIG. 5 the grooves 26 are transverse, at right angles. These grooves enable the skirt of the seal to follow any substantial radial deformation of the tube which is to be expanded, whilst retaining their flexible characteristic. This option is advantageous when the material used for the skirt 22 would not be able to follow any substantial deformation without being plasticised, if the skirt were made without grooves.

The construction of the seal in the form of a skirt gives the seal a flexibility which enables it to adapt perfectly to variations in the diameter of the tubes. This flexible and resilient behaviour ensures that the tubes are always adequately expanded, irrespective of the manufacturing tolerances of the diameter of the tubes and of the diameter of the holes which receive these tubes.

Moreover, the transition between the expanded portion and the non-expanded portion of the tube is much gentler in configuration than in conventional tube expansion. In particular, the shape of the skirt of the seals may be designed so that the deformation of the tube does not bring about stresses in the tube which would lead to cracking; this increases the reliability of the apparatus and avoids shutdowns of the plant and sealing of the defective tubes.

Finally, owing to the great flexibility of the seal according to the invention, which enables it to adapt to any manufacturing tolerances of the tubes and of the holes which are to receive these tubes, it is possible to provide sets of a plurality of identical tube expanders combined in the same hydraulic distribution unit, so that a number of tubes can be expanded simultaneously.

The hydraulic distribution units may take various geometric forms. In particular, the unit which will be used to expand the central portion of a tube plate of a steam generator, for example, might be of rectangular cross-section (section parallel to the surface of the plate), whereas at the edge of the tube plate, a unit of partially curved cross-section might be used. This makes it possible to reduce the tube expansion time considerably (by a factor 2 to a factor 10 depending on the number of tubes and the depth which is to be expanded), thereby reducing the manufacturing costs and time.

The length of the body of the tool is adjusted in accordance with the local thickness of the plate in which the tube which is to be expanded is to be mounted. FIG. 6 shows the tool according to FIG. 1 positioned in a tube T which is to be expanded in a tube plate PT. The tool is positioned in such a way that the seals 2 and 3 which define the annular expansion chamber 20 are located in line with the intake and outlet passages of the tube T in the tube plate PT so that correct expansion of the tube T is ensured over its entire length.

FIG. 7 illustrates a variant of the tool in FIG. 1. In this embodiment, the body 1 of the tool has a flexible seal formed by joining together the skirts 22 of two simple seals 2, 3 as described in the previous embodiment. The double seal of FIG. 7 defines externally an annular internal cavity 20 which forms a chamber for receiving the expansion fluid. The hollow double seal 2 comprises two heads 21 fixed on the outer surface of the body 1 and a skirt 22 of flexible or relatively flexible material which joins together the heads 21. The skirt 22 has an outer marginal zone 24 which fits directly against the inner surface of the tube T which is to be expanded along a length which may be selected as a function of the thickness of the tube plate PT in which the tube is expanded. This embodiment is useful when the tube plate is thick: this applies particularly to tube plates for steam generators for nuclear power stations, which have a thickness of the order of 500 mm.

The hollow seal 2–3 is clamped between two rings 11A and 11B held by compression members fixed on the body 1. In the embodiment shown, the compression members comprise, on each side of the seal, rods 15 and rings 17 and 18 coupled by ball bearings 14 and 16, each assembly being held under compression by a ring 19 retained by a nut (not shown) tightened on the spindle 1.

When the expansion fluid is introduced into the chamber 20, the skirt 22 exerts radial pressure on the tube T and the heads 21 exert axial thrust on the rings 11A and 11B, this axial thrust being transmitted by the elements 14–19 to the compression nuts which balance out the axial thrust.

Figure 9:
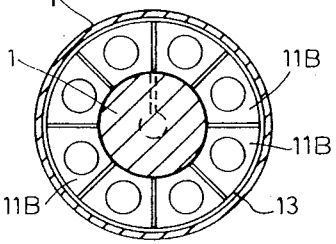

The rings 11A and 11B may consist of a plurality of sectors as shown, for example, in the cross section in FIG. 9. Internal seal covers 12 prevent extrusion of the flexible seal between two successive sectors of the rings 11A and 11B during radial expansion of these sectors which occurs while the expansion operation is carried out.

A cylindrical cover 13 holds the sectors which form the rings 11A and 11B: it serves as a stress distributor between the sectors and the tube T and thus prevents internal marking of the tube T by the sectors. This cover 13 is also shown in FIG. 8. Its outer surface fits against the inner surface of the tube which is to be expanded, which is seen in position in a thin tube plate PT. In this embodiment, the rings 11A and 11B have a portion which envelops the flexible skirt 22 of the seal and it will be seen that the rings abut closely on one another around the central portion 27 of the skirt of the seal.

The cylindrical cover 13 is advantageously provided with grooves as shown, for example, by the lines 28 in FIGS. 13 and 14. In this embodiment, the grooves 28 extend axially. They could also be helical, for example.

Figure 10:
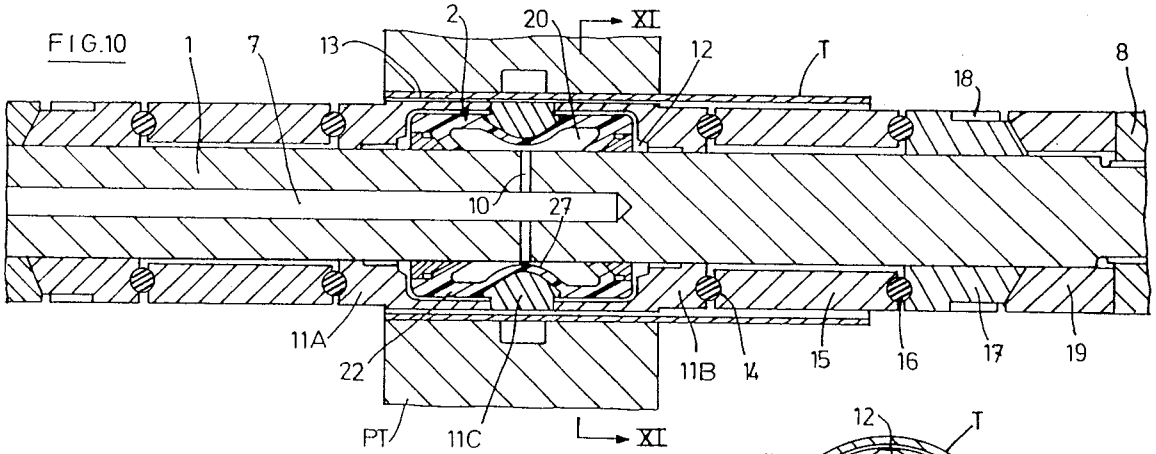
Figure 11:
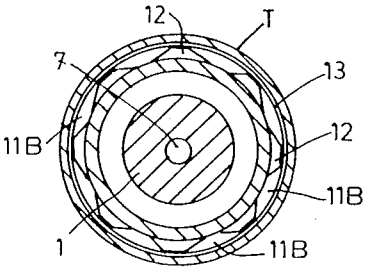

In certain tube plates, circular grooves are formed in the surface of the holes which are to receive the tubes, in order to define counterpressure chambers. These chambers help to prevent fluid from moving from one side of the plate to the other. These grooves interrupt the abutment of the tubes on the inner surface of the holes. In order in this case to prevent the tube from undergoing deformation during its expansion, the invention proposes an alternative embodiment of the hollow seal as shown in FIG. 10. Opposite the circular groove, the sleeve comprises an intermediate ring 11C clamped between the rings 11A and 11B described above, this intermediate ring being more rigid than the lateral rings 11A and 11B, so as to prevent deformation of the tube T which is to be expanded level with the groove during the expansion. The seal 2 in this case has a median portion 27 of more sophisticated shape in order to match the internal profile of the intermediate ring 11C. FIG. 11 is a cross-section on the line XI—XI of FIG. 10.

Figure 12:
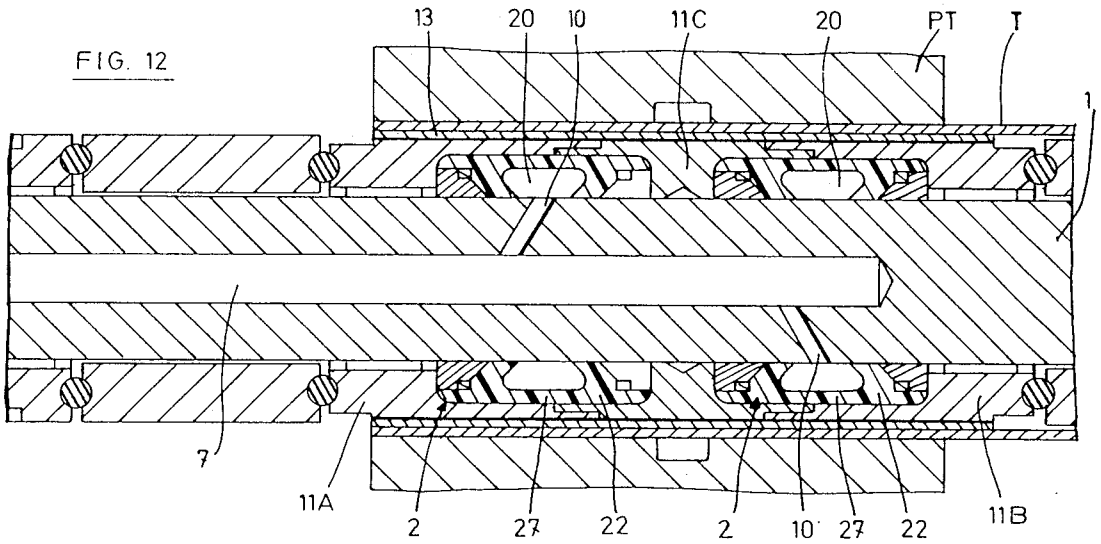

If the radial spacing between the inner wall of the tube T which is to be expanded and the spindle 1 is only small, an expansion device may be provided comprising several annular expansion chambers 20 as shown in FIG. 12, for example. In this figure, two chambers 20 are defined by two hollow seals 2 according to the invention distributed along the spindle or elongate body 1. As can be seen, the two seals 2 are separated by an intermediate ring 11C which faces the circular groove formed in the tube wall PT in this example.

In the case of hydraulic expansion over long length (self-binding), the pressure which builds up in the annular expansion chamber 20 exerts an end effect on the ends of the tool and elongates it. This elongation causes displacement of the seals with the result that they slide over the inner wall of the tube during the build up of pressure. This sliding may be prejudicial to satisfactory behaviour of the seal under pressure. This sliding can be avoided in the embodiment shown in FIG. 15.

FIG. 15 shows an expansion tool according to the invention in position in a long tube T which is to be self-bound. The middle part of the drawing is omitted and only the ends of the tool are shown. This drawing shows the elongate body of the tool or the spindle 1, the skirt seals 2 and 3 according to the invention and the expansion fluid intake channel 7. This embodiment is characterised in that, towards its ends, the body 1 has two compartments 31 and 32, referred to as pressure compartments, communicating with each other via an internal expansion chamber 33 which passes axially through the body 1. In the examples shown, the pressure compartments 31 and 32 are formed by closures 34 and 35 screwed into the body 1. The internal ends of the closures are fitted with seals 36, 37. The pressure compartment 32 communicates not only with the internal expansion chamber 33 mentioned above but also with a pressure fluid intake channel 38 the function of which will become apparent from the description of the process of expanding the tube T.

This process according to the invention proceeds as follows. A pressurised fluid (arrow B) is injected progressively through the channel 38 into the body 1 and spreads through the compartment 32 and, via the internal expansion chamber 33, into the compartment 31, creating in these compartments a pressure P1 which is exerted on the cross-sections of the stoppers 34 and 35 and there gives rise to increasing end effects. Any difference in the end effects are absorbed by the rings 41 and 42. The end effects created in the pressure compartments 31 and 32 cause elongation A1 of the expansion tool whilst the seals 2 and 3 slide over the tube T without any pressure being applied in the annular expansion chamber 20.

Then, the expansion fluid (arrow A) is injected progressively through channel 7 into the annular chamber 20, creating a pressure P2 which is exerted on the sections below the skirts of the seals 2 and 3, creating end effects there. While the pressure P2 is rising, the pressure P1 is reduced so that the sum of the end effects created in the expansion chambers 20 and 33 keeps the elongation A1 of the tool constant throughout the expansion of the tube T. As a result, the seals 2 and 3 do not move axially during the increase in pressure in the annular expansion chamber 20.

When the expansion of the tube T is finished, the pressure P2 is reduced and at the same time the pressure P1 is raised again so that the sum of the end effects still keeps the elongation A1 constant during the drop in pressure in the annular chamber 20. As a result, the seals 2 and 3 do not move axially during the drop in pressure in the expansion chamber 20 and when the pressure in said chamber becomes zero, the pressure P1 can also be lowered to zero.

Thanks to this design of the tool and the expansion process as described, the seals 2 and 3 move only when the pressure is zero in the expansion chamber 20, thus ensuring a leaktight seal during the rise in pressure of the expansion fluid and so lengthening the service life of the seals.

I claim:

1. A hydraulic expansion tool for a tubular element, said tool comprising:

an elongated body having two opposed ends and an external surface;

a first seal having a first head portion and a first skirt portion, said first head portion disposed at one end of the elongated body and said first skirt portion surrounding the one end of the elongated body and oriented towards the opposite end of the elongated body, said first seal suitably dimensioned and flexible to seal an inner surface of a tubular element when said tool is introduced into said tubular element;

a second seal having a second head portion and a second skirt portion, said second head portion disposed at the opposite end of the elongated body and said second skirt portion surrounding the opposite end of the elongated body and oriented towards the one end of the elongated body, said second seal suitably dimensioned and flexible to seal said inner surface of said tubular element when said tool is introduced into said tubular element;

first compression means for securing and sealing said first head portion of said first seal against said one end of said elongated body;

second compression means for securing and sealing said second head portion of said second seal against said opposite end of said elongated body; and means, axially traversing one of said first or second compression means, for communicating pressurized fluid from outside to within a space defined by the first and second seals and the external surface of the tubular body.

2. A tool as set forth in claim 1 wherein said first or second skirt portion of said first or second seal, respectively, is divided into sections by a plurality of grooves.

3. A tool as set forth in claim 1 wherein the diameter of said first or second skirt portion of said first or second seal, respectively, at an outer edge thereof is slightly larger than the internal diameter of said tubular element.

4. A tool as set forth in claim 1 wherein a diameter of an outer surface of said first or second skirt portion of said first or second seal, respectively, over a predetermined marginal zone is slightly greater than the internal diameter of said tubular element.

5. A tool as set forth in claim 1 wherein said elongated body comprises a plurality of body sections threadably connected to each other within said tubular element whereby the length of said elongated body is adjustable.

6. A tool as set forth in claim 1 wherein said means for communicating pressurized fluid includes an axial aperture in one of said first or second compression means and an axial aperture in one of said corresponding first or second seals.

7. A tool according to claim 6 wherein said means for communicating pressurized fluid further includes:

means defining a radial aperture in a sidewall of said tubular body to pass fluid from within said tubular body outwardly of said tubular body and thereby expand said tubular element.

* * * * *